United States Patent [19]

Stefan

[11] 4,454,035

[45] Jun. 12, 1984

[54] POOL SKIMMER

[75] Inventor: Gunter Stefan, Toronto, Canada

[73] Assignee: Kafko Manufacturing Limited, Mississauga, Canada

[21] Appl. No.: 392,264

[22] Filed: Jun. 25, 1982

[51] Int. Cl.[3] ..... E04H 3/20

[52] U.S. Cl. ..... 210/117; 4/508; 134/178; 210/123; 210/169; 210/242.1; 210/245; 210/416.2

[58] Field of Search ..... 210/169, 244, 245, 246, 210/242.1, 117, 123, 103, 110, 108, 416.2; 134/178, 167 R; 4/506, 507, 508, 493; 251/301, 298

[56] References Cited

U.S. PATENT DOCUMENTS

| | | | |
|---|---|---|---|
| 3,567,020 | 4/1971 | Whitaker | 210/169 |
| 3,701,427 | 10/1972 | Howard | 210/169 |
| 3,706,379 | 12/1972 | Erlich | 210/169 |
| 3,910,840 | 10/1975 | Adam | 210/169 |
| 3,924,834 | 12/1975 | Babcock | 251/301 |
| 4,154,679 | 5/1979 | Farage | 210/169 |

FOREIGN PATENT DOCUMENTS

| | | |
|---|---|---|
| 791471 | 8/1968 | Canada . |
| 902518 | 6/1972 | Canada . |
| 993808 | 7/1976 | Canada . |
| 1077403 | 5/1980 | Canada . |

OTHER PUBLICATIONS

Hayward Manufacturing Company, Inc., "Installation and Operating Instructions" for Automatic Surface Skimmer, date approximately 1976.

*Primary Examiner*—Peter A. Hruskoci
*Assistant Examiner*—Sharon T. Cohen
*Attorney, Agent, or Firm*—Moss, Hammond

[57] ABSTRACT

An improved combination pool skimmer is disclosed which may be adapted to provide surface water skimming, or subsurface water sweeping or vacuuming of a swimming pool. The skimmer has a body including a throat for entry of water into the skimmer and a well located below and communicating with the throat. The skimmer has a single relocatable cover plate adapted to be located in the well of the skimmer to cover the skimmer pump outlet port. The well has a peripheral shoulder adjacent to the throat on which a removable strainer basket is supported. The strainer basket has an annular ring or flange which is disposed on this shoulder for this purpose. The cover plate may be supported on the basket annular ring to cover the basket and control entry of water into the well. A snap-in hinged weir and a snap-in hinged equalizer flap valve are provided in the skimmer which are not subject to corrosive decay by pool chemicals. Various slide valves are provided to adapt the skimmer for the various functions referred to above.

12 Claims, 10 Drawing Figures

POOL SKIMMER

BACKGROUND OF THE INVENTION

This invention relates to skimming systems for swimming pools and the like, and more specifically, to multi-use skimming systems which are adaptable to skim and vacuum debris from a swimming pool.

Swimming pools, both residential and commercial, are customarily equipped with one or more skimming devices to remove the film and floating objects which collect on the surface of the water. Moreover these skimming units are typically adapted to remove debris which sinks to the bottom of the pool to rest on the floor thereof. Skimming units in accordance with the above are connected to a recirculating fluid system which includes a pump for removing water through the skimming device and forcing this water through a filter before it is returned to a discharge outlet into the swimming pool. The recirculation system may include water heaters, treating equipment, etc.

Such skimming devices usually comprise a skimmer body which is built into the side wall of the swimming pool being provided with a liquid surface throat that opens to the surface of the water in the swimming pool. Surface water from the pool flows through the liquid surface throat, and thereafter the water usually passes through a strainer basket which is intended to catch large objects, as for example leaves and the like, which could damage the recirculating pump or impeller or otherwise clog the recirculating system. A vertically self-adjusting weir may be provided in the liquid surface throat which adjusts itself upwardly and downwardly in correspondence with variations in the level of the water in the pool. The principal purpose of the weir is to provide maximum surface flow velocity of the water into the skimmer body which results in a more efficient removal of surface film and debris consisting of dust particles, oils, leaves and the like on the surface of the water.

Also provided in said skimmer units is a liquid well into which a strainer basket can be placed. The water drawn through the liquid surface throat is drawn into the well by gravity and by the recirculating pump. A well outlet port leading to the pump is provided at the bottom of the well. Since the water in the skimming system is continually recirculating from the skimmer through the filtering equipment of the pump back into the pool, it is necessary for the pump or the liquid well of the skimmer body to continually be provided with new water to ensure that the recirculating system does not run dry. Should the recirculating system run dry, damage to the recirculating pump may occur. As well, repriming of the entire circulating system may become necessary.

To avoid having the liquid well in the skimmer body run dry, a further connection called an equalizer may be made between a pool inlet port in the well and an intake opening in the pool wall sufficiently below the water surface to ensure that water will be available to the well even where the level of the pool falls below the liquid surface throat. Alternatively, the pool inlet port may be located to provide a suction in the floor of the pool at, for example, the main drain connection of the pool. With suitable valving provided in an adaptor located in the bottom interior of the liquid well, a combination skimmer with a main drain connection such as this permits the bottom of the pool to be cleaned by the water being drawn into the main drain by the skimmer system thereby drawing any debris which may be found at the bottom of the pool into the filtration system attached to the skimmer body.

Moreover, such skimmer devices have been provided with an additional cover plate which may be placed over the strainer basket within the liquid well, the cover plate being provided with a hole passing therethrough to which a hose can be attached. With suitable adjustments to the valves in the adaptor within the skimmer body, the hose connected to the cover plate may be used to draw water into the skimmer well. Placing the free end of this hose into the swimming pool permits vacuuming of the floor of the swimming pool, particularly in regions remote from the main drain which cannot be cleaned by the suction of the water entering the main drain.

Thus it may be seen that a skimmer may be used to remove all debris which is collected in a pool during the course of its use. However, it has been found that prior art skimmers which attempt to accomplish the functions described above have disadvantages or inconveniences which make such skimmers costly to manufacture, difficult to use, or expensive to maintain.

For example, the vertically self-adjusting weir of the prior art devices may require several manufacturing steps to be performed. Heretofore, the weir body typically has been manufactured as one piece, the skimmer body in the vicinity of the liquid surface throat was manufactured as a separate piece, and the two were placed together into an operational unit by drilling suitable holes therethrough and providing a further hinge pin through the holes thereby providing a rotatable connection between the weir and the liquid surface throat.

In equalizer skimmers provided with a pool inlet port communicating with an intake opening in the pool wall substantially below the pool water surface, it is necessary to provide the pool inlet port with an equalizer valve which decreases or cuts off the flow of water into the liquid well from the pool inlet port to ensure that surface water is drawn into the liquid well over the weir. Heretofore, the equalizer valve on the pool inlet port typically has been a flap valve or other sealing valve releasably sealing the pool inlet port by spring force. The springs found on such valves tended to corrode and deteriorate into inoperability after a short period of use of the skimmer because of the presence of chemicals in the pool water. Moreover, skimmers are commonly used as a location for introducing chemicals, such as sodium hypochlorite or calcium hypochlorite, which are used for health reasons in the pool. These chemicals are highly corrosive and their constant presence around the metal springs and screws of the equalizer valve of the pool inlet port was found to cause the prior art valves to deteriorate into inoperability. Therefore, frequent replacement of these springs or screws or the valves themselves was necessary to ensure the continued proper operation of the skimmer device.

In combination skimmer assemblies provided with cover plates which enabled vacuuming of the pool bottom to be performed, it was found that an additional valve-containing adaptor was required to control the amount of flow or suction provided for each of the vacuuming function and main drain sweeping function. This need for a separate adaptor increased the manufacturing cost, and therefore the final cost of these skimming devices simply owing to the number of pieces which were required for the skimmer device. Also, the adaptor had to be placed into a storage area away from the skimmer assembly when not in use where it could become lost or misplaced.

SUMMARY OF THE INVENTION

In the present invention, a separate valve-containing adaptor has been eliminated and a single relocatable cover plate is used to control flow into the well or into the pump outlet. A removable annular ring supports the cover plate to control flow into the well, or the annular ring can be removed and the cover plate located down in the well over the pump outlet.

According to the present invention a pool skimmer is provided comprising a skimmer body having means defining a throat adapted to communicate with the water surface of a pool for entry of pool water into the skimmer. The skimmer body also has a well located below the throat, the well having an upper peripheral shoulder defining a well inlet communicating with the throat. The well also has means defining a pump outlet port located in the bottom thereof forming a well outlet. A relocatable cover plate is adapted to be located in the well to cover the pump outlet port, the cover plate having a peripheral edge portion and an interior liquid flow port for flow of liquid therethrough. Also, a removable annular ring is adapted to be located on the well peripheral shoulder, the ring having a central opening smaller in cross-sectional area than the cross-sectional area of the cover plate, so that the cover plate can be positioned on the annular ring to cover the well inlet.

BRIEF DESCRIPTION OF THE DRAWINGS

A preferred embodiment of the invention will now be described by way of example with reference to the accompanying drawings, in which.

DETAILED DESCRIPTION OF THE PREFERRED EMBODIMENT

Figure 1:
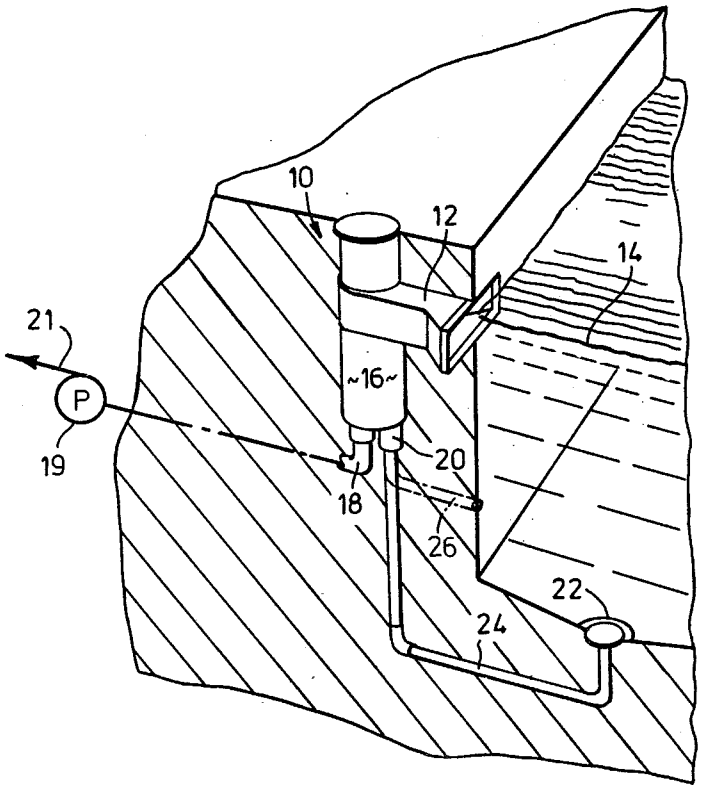
FIG. 1 is a diagrammatic view, partly broken away, illustrating a typical installation in a swimming pool of a preferred embodiment of a pool skimmer according to the present invention.

Referring firstly to FIG. 1, a diagrammatic view of a section of a swimming pool wall is shown having a preferred embodiment of a skimmer 10 mounted in the side thereof. The skimmer 10 is provided with a liquid surface throat 12 which is positioned to communicate with the water surface 14 of the pool. The skimmer is also provided with a skimmer well 16 which has a pump outlet port 18 connected to the bottom thereof. The pump outlet port 18 forms a well outlet and leads to a recirculating pump 19 and filtering mechanism (not shown), which are usually mounted above ground away from the swimming pool. The pool water drawn from skimmer 10 by pump 19 is returned to the pool by a recirculating discharge port 21 to provide a constant recirculation of the pool water through the recirculating filtering apparatus.

It will be appreciated that when evaporation or water losses from the pool cause the pool surface 14 to go below the liquid surface throat 12, no water may enter the skimmer well 16 via the liquid surface throat. To avoid having the pump 19 run dry, a pool inlet port 20 may be provided at the bottom of the skimmer well 16. The pool inlet port is connected to communicate with the water in the pool substantially below the surface of the pool in either of two mutually exclusive locations. The first location is connection to the main drain 22 of the pool via pipe 24, as shown in solid lines in FIG. 1. When a skimmer assembly is provided with a connection such as this, it is referred to as a combination main drain skimmer or a combination skimmer with main drain connection. As may be appreciated, a main drain skimmer will extract water from the pool through the main drain 22 as well as surface water from the pool via liquid surface throat 12, as long as the level of the pool surface 14 is at or above the entrance or intake of throat 12.

Alternatively, pool inlet port 20 may be connected to the pool by an equalizer line or pipe 26 shown in chain dotted lines in FIG. 1. Equalizer pipe 26 passes through the wall of the pool substantially below the surface thereof to communicate with the water in the pool. When skimmer 10 is configured thusly, it is referred to as an equalizer skimmer or a skimmer with an equalizer valve.

Figure 2:
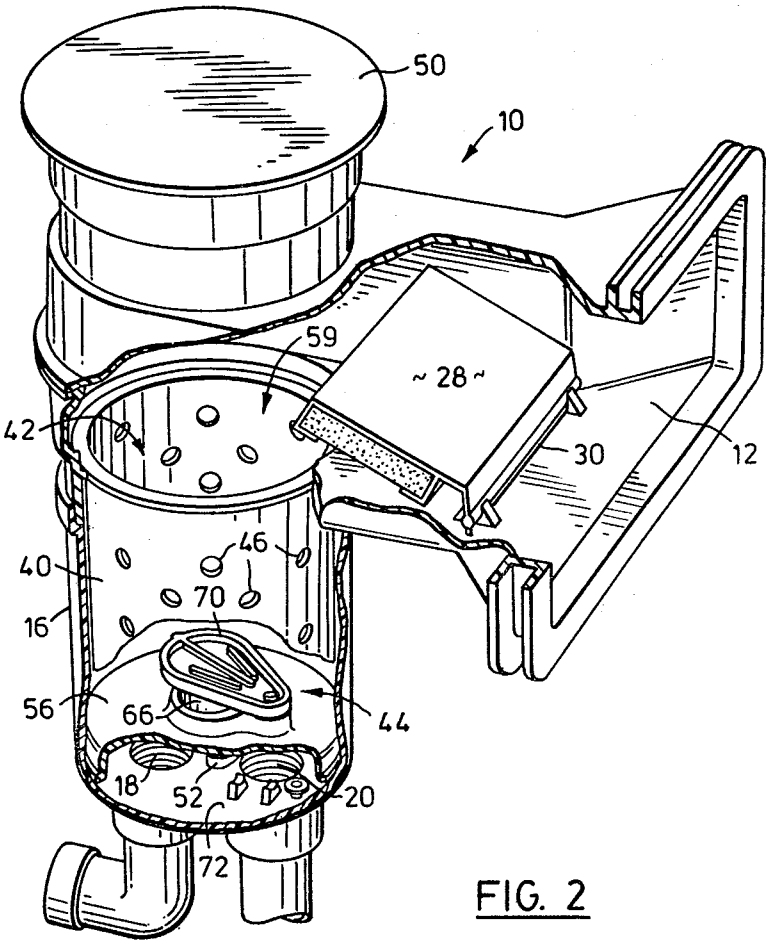
FIG. 2 is a perspective view, partly broken away, of the preferred embodiment of the skimmer shown in FIG. 1, showing it configured as a combination skimmer with main drain connection.
Figure 3:
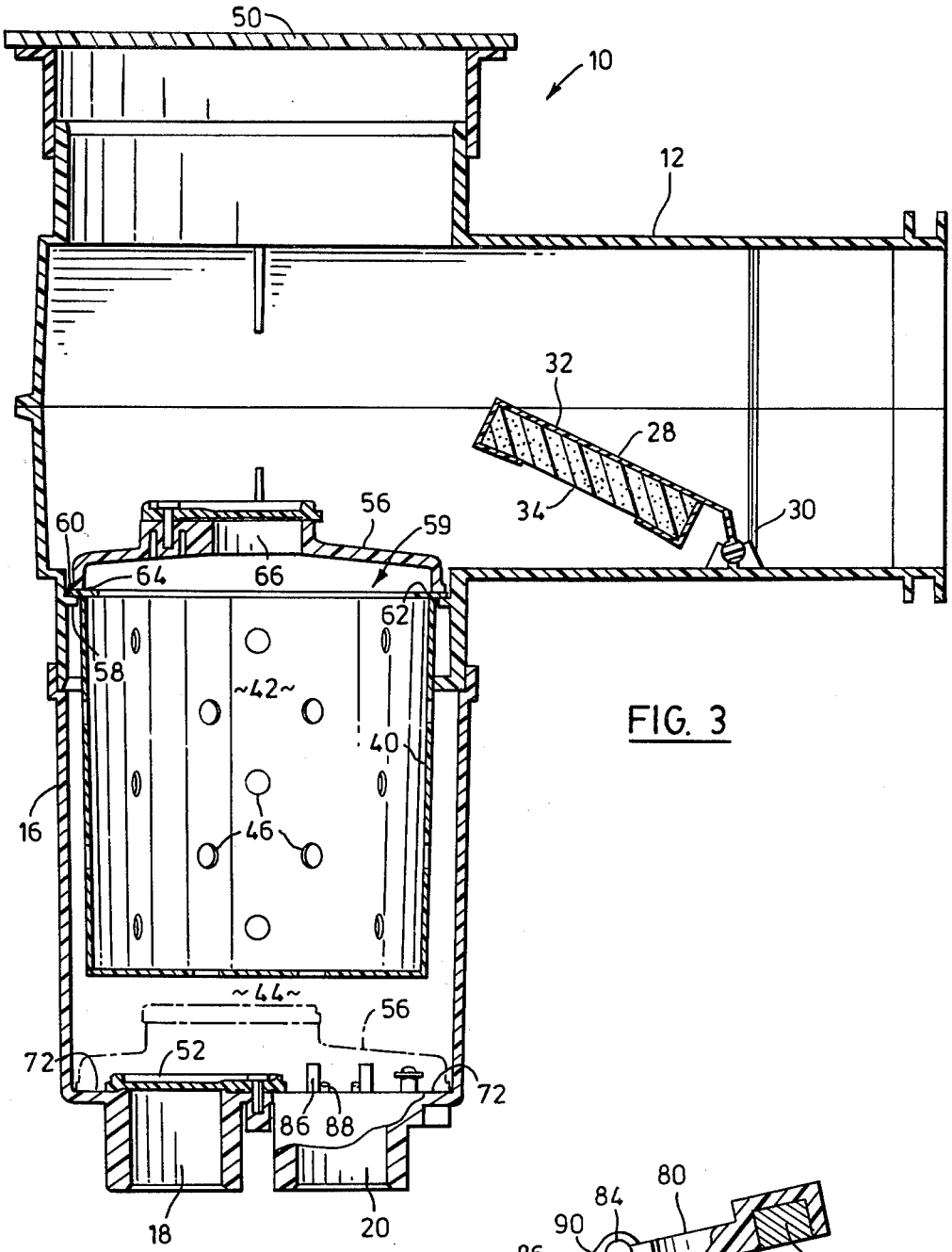
FIG. 3 is a vertical sectional view of the preferred embodiment of this invention illustrating different configurations thereof.

Referring now to FIGS. 2 and 3, skimmer 10 is shown respectively with liquid surface throat 12 and well 16 partly broken away and in section to illustrate better the pump outlet port 18 and pool inlet port 20. The liquid surface throat 12 is provided with an upright vertically self-adjusting weir 28 which is hingeably connected to the skimmer throat by a hinge 30 which will be described in more detail hereafter. The provision of a vertically self-adjusting weir 28 in the liquid surface throat 12 is made to ensure that the velocity of the surface water passing over the weir is maximized notwithstanding height variations in the surface level of the pool water. The vertically self-adjusting weir is manufactured from a resilient shell 32 which can be formed of extruded plastic material. Resilient shell 32 encases a block of flotation material 34 which causes the weir to move upwardly and downwardly with the surface level of the water in the liquid surface throat 12. This flotation material 34 may be composed of any suitable foam or sponge material, preferably closed cell plastic foam.

A removable strainer basket 40 is shown disposed within the well 16. The strainer basket divides the liquid well 16 into a prestrainer region 42 and a post strainer region 44 whereby any contaminated water passing from the prestrainer region 42 into the post strainer region 44 will have to pass through the removable strainer basket 40 by passing through holes 46 provided in the strainer basket. The holes 46 may be of any suitable shape or configuration that will prevent the passage through the strainer basket of larger objects, such as leaves, bugs, cigarette butts and the like. The water passing through basket 40 into post strainer region 44 will be drawn into the pump outlet port 18 where it will be drawn into the recirculating pump and filtration system (see FIG. 1) which is provided in the pool filtration system.

Pool inlet port 20 may be plugged, or connected to the pool main drain, or connected to an equalizer pipe depending on the purpose to which the skimmer assembly is being put as is explained hereafter.

Figure 4:
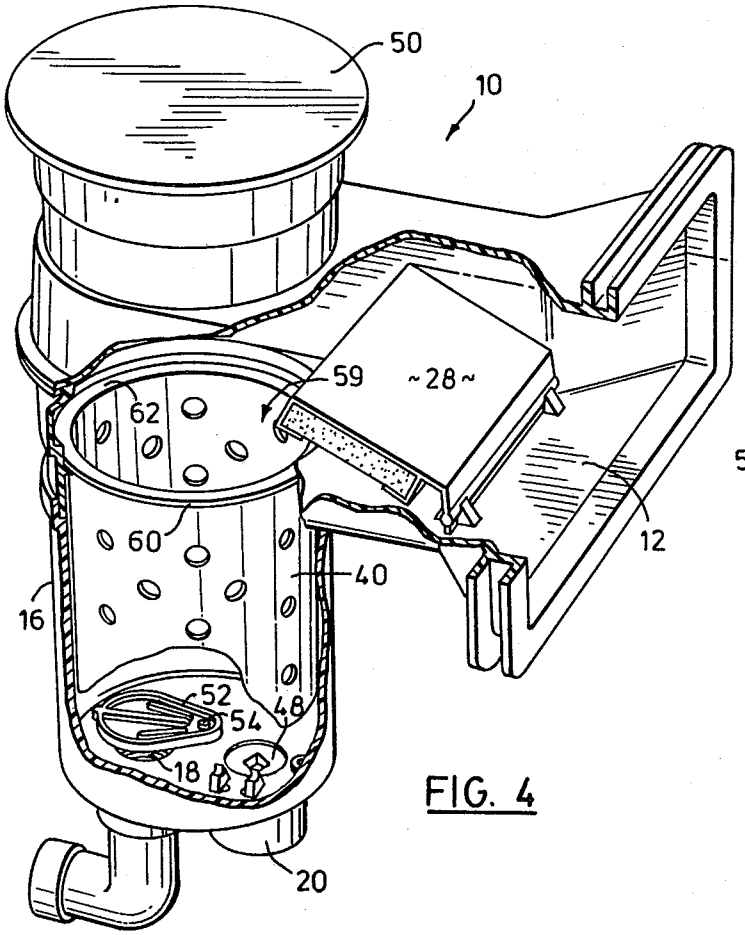
FIG. 4 is a perspective view, partly broken away, of the preferred embodiment of the invention showing it configured as a skimmer alone.

Referring now to FIG. 4, skimmer 10 is shown configured as a skimmer alone. In this configuration of the skimmer, a plug 48 is placed into the pool inlet port 20 to prevent water from entering into the skimmer well 16, and main drain pipe 24 and equalizer pipe 26 may be omitted on installation of the skimmer. Therefore, all water entering skimmer 10 must do so through the liquid surface throat 12. Accordingly, the skimmer in this configuration does nothing more than skim debris from the surface of the pool water. Such debris is trapped in the removable strainer basket 40. The debris so trapped may be emptied from the strainer basket 40 by removing the skimmer lid 50 and extracting the basket from the skimmer well for emptying.

Optionally, the pool outlet port 18 may be provided with means for selectively closing the pool outlet port. In the preferred embodiment, the means for selectively closing the pool outlet port are formed from a rotatable slider valve 52 which may be manually slid over the pool outlet port 18 by rotating same about pin 54. The means for selectively closing the pump outlet port 18 are useful where a plurality of skimmer assemblies are placed in hydraulic parallel and must be balanced in the recirculating pump system of a pool. This occurs when two or more skimmers are required for a single pool. The provision of these means for selectively closing the pump outlet port enables the skimming obtained by any individual skimmer to be varied selectively by opening or closing the slide valve 52 thereby permitting greater or lesser fluid flow into the respective pump outlet port 18.

Figure 5:
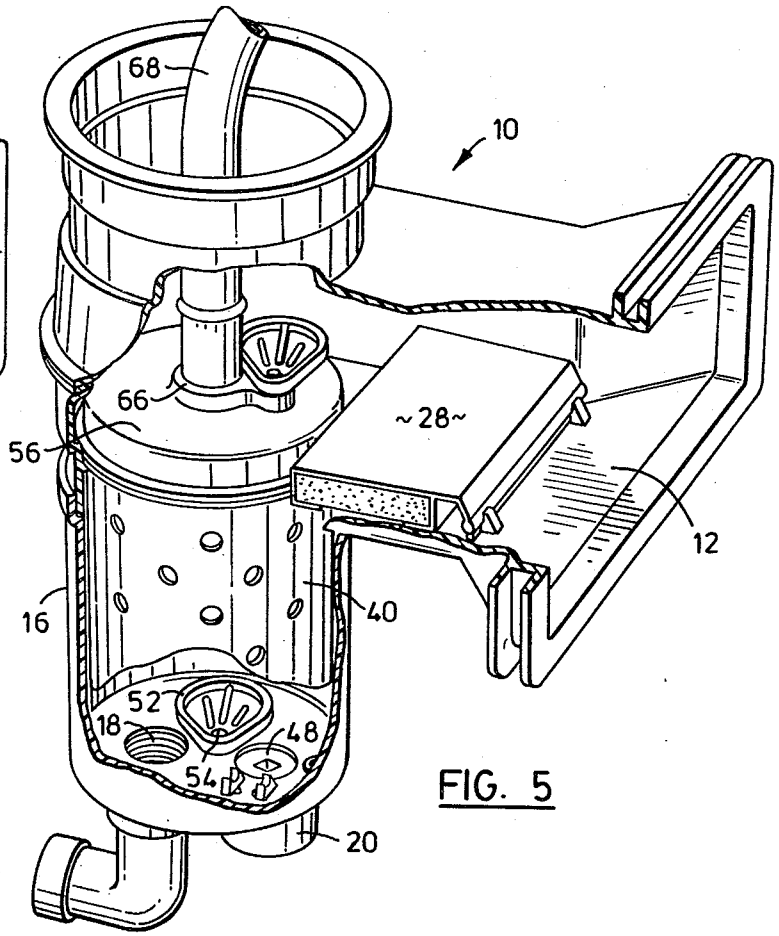
FIG. 5 is a perspective view, partly broken away, of the preferred embodiment of the skimmer shown in FIG. 4 showing it configured as a pool vacuum.

Referring now to FIG. 5, the skimmer alone configuration of the skimmer shown in FIG. 4 is shown now configured as a pool vacuum. In this configuration, the plug 48 remains in the pool inlet port 20. The slider valve 52 is not necessary in this configuration, but if it is present, it may be rotated completely out of contact with pump outlet port 18 thereby permitting maximum fluid flow through pump outlet port 18. The previously shown skimmer lid 50 is not shown as it has been removed from the top of the skimmer 10. A relocatable cover plate 56 is shown positioned above the removable strainer basket 40. Cover plate 56 has an interior liquid flow port 66 for flow of liquid therethrough. As shown in FIG. 3, the relocatable cover plate 56 is positioned over the removable strainer basket 40 with the peripheral edge portion of the cover plate resting on an annular ring or flange 60, which in turn is supported by a peripheral shoulder 58 provided at the top portion of the skimmer body 10 in the top interior portion of the skimmer well 16. Shoulder 58 defines a well inlet 58, communicating with throat 12. It will be appreciated that the flange 60 of basket 40 forms a removable annular ring with respect to peripheral shoulder 58. This annular ring has a central opening which is smaller in cross-sectional area than the cross-sectional area of cover plate 56, so the cover plate will not pass therethrough into basket 40. However, the well inlet 59 defined by shoulder 58 is larger in cross-sectional area than that of cover plate 56, so plate 56 can pass through peripheral shoulder 58 and enter well 16 when strainer basket 40 is removed, as will be described further below. Basket flange 60 is provided with a smooth sealing surface 62 upon which rests a mating sealing surface 64 formed by the peripheral edge of the relocatable cover plate 56. Thus the cover plate 56 is so positioned that it seals the well inlet 59 such that only fluid passing through the liquid flow port 66 of the relocatable cover plate may enter into the skimmer well 16. Referring again to FIG. 5, the relocatable cover plate 56 positioned as aforesaid is shown having a vacuum hose 68 fitted into the liquid flow port 66. Accordingly, the liquid drawn out of the skimmer well 16 via the pump outlet port 18 may only be drawn into the skimmer well 16 via the vacuum hose 68. Vacuum hose 68 is long enough to reach into the bottom of the pool to provide a vacuuming action on the pool floor in all areas including those areas remote from any main drain which may be present in the pool.

Reference is again made to FIGS. 1 to 3, where skimmer 10 is shown configured as a combination main drain skimmer. In this configuration, control plate 56 is positioned inside and on the bottom of skimmer well 16 below strainer basket 40 to sealably rest against the bottom of well 16 and cover pump outlet port 18. (A phantom outline of the relocatable cover plate in this position is shown in FIG. 3). Pool water is allowed to enter into skimmer well 16 via pool inlet port 20, or via well inlet 59 from throat 12. All fluid entering into the skimmer well 16 is drawn out of the well via pump outlet port 18. The mixture or ratio of surface water drawn from the pool through liquid surface throat 12 and subsurface water drawn in through the main drain ultimately into skimmer well 16 via pool inlet port 20 may be controlled by the positioning of a control slide valve 70 for closing flow port 66, together with the slide valve 52 for closing inlet port 20. In the position of these valves shown in FIG. 2, little surface water is allowed to mix with the subsurface pool water since all surface water entering through the liquid surface throat 12 must pass through the liquid flow port 66, which is partially closed by slide valve 70. However, slide valve 52 is positioned so as not to obstruct pool inlet port 20, thereby permitting a maximum flow from the main drain into skimmer well 16 via pool inlet port 20. As may be appreciated, control slide valve 70 may be rotated to fully uncover liquid flow port 66 thereby permitting greater flow therethrough of the water skimmed from the surface of the pool via liquid surface throat 12. The surface skimming obtained may be increased further by rotating slide valve 52 to close partially or completely cover pool inlet port 20 thereby decreasing the flow of water extracted from the subsurface of the pool. It will be appreciated that valves 52, 70 permit any combination of flow rates entering the respective inlet port 20 and throat 12.

The relocatable cover plate 56 shown at the base of the skimmer well 16 is the same shape in all the figures of this specification employing same. As mentioned above, the same cover plate 56 may be used in the skimmer both above the removable strainer basket 40 as shown in FIGS. 3 and 5 and below the removable strainer basket 40 as is shown in FIG. 2 and in phantom in FIG. 3. To insert the relocatable cover plate 56 below the strainer basket, the strainer basket is temporarily removed and the relocatable cover plate then may be freely moved past shoulder 58 located in the interior of skimmer well 16 (the relocatable cover plate 56 is only prevented from entering into skimmer well 16 when the removable strainer basket 40 is in place). Thereafter, the relocatable cover plate 56 is positioned at the bottom of skimmer well 16 in the position shown in FIG. 2. In this position, the relocatable cover plate seals against the bottom surface 72 of the skimmer well whereupon the removable strainer basket 40 may be reinserted into the skimmer well to rest against shoulder 58.

Figures 6, 7, 8, 9:
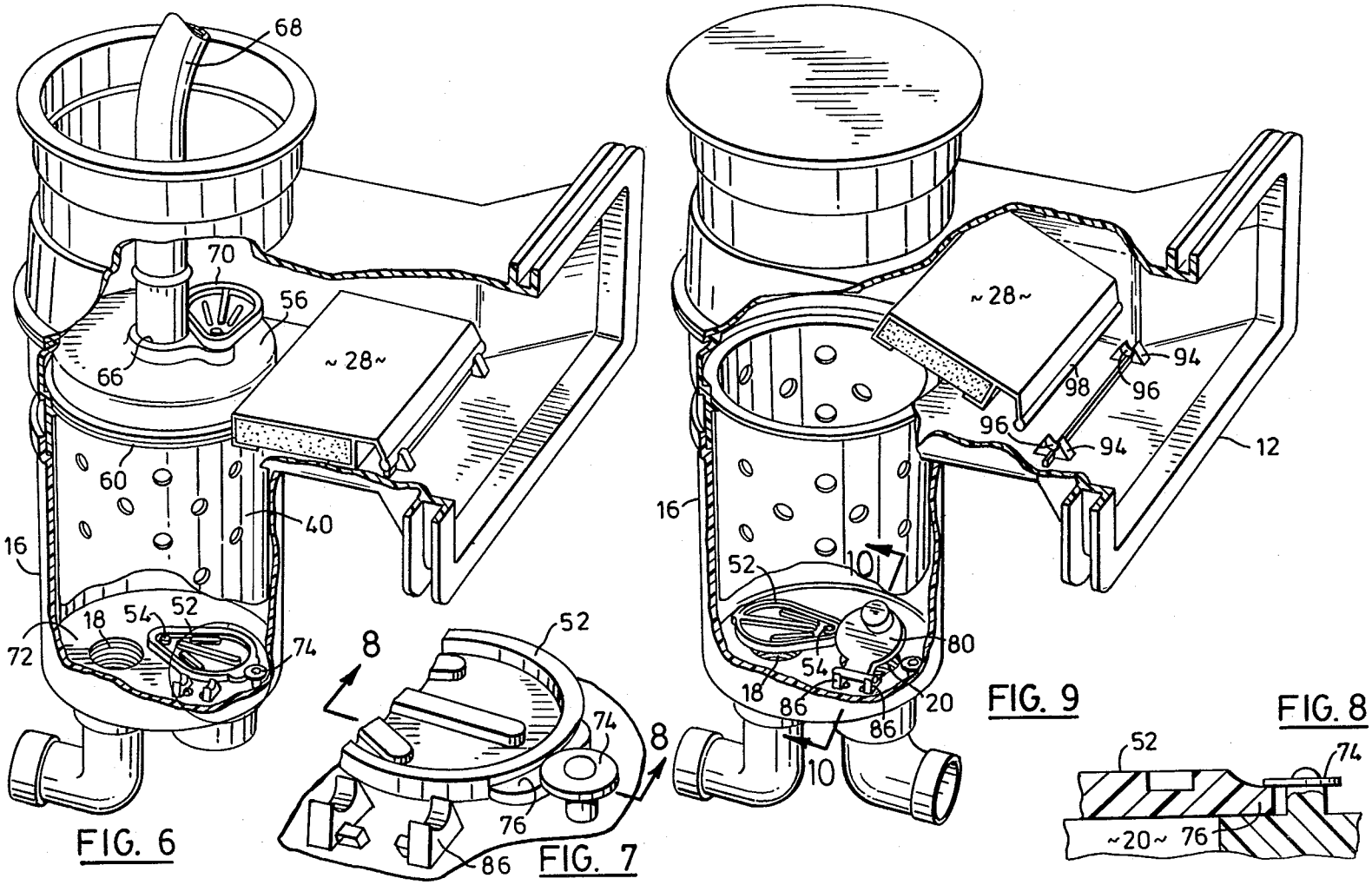
FIG. 6 is a perspective view, partly broken away of the embodiment of the skimmer shown in FIG. 2, showing the combination skimmer with main drain connection being configured for use as a pool vacuum.
FIG. 7 is an enlarged view of the encircled portion of FIG. 6 showing detail of the closure of the slide valve.
FIG. 8 is a cross-sectional view of the slide valve shown in FIG. 7 taken alone line 8-8 of FIG. 7.
FIG. 9 is a perspective view, partly broken away, of the preferred embodiment of the skimmer showing it configured as an equalizer skimmer.

Referring now to FIGS. 6, 7 and 8, the combination main drain skimmer illustrated by FIG. 2 is shown here in FIG. 6 reconfigured to provide a pool vacuum system. To transform the combination skimmer of FIG. 2 into the pool vacuum system of FIG. 6, the skimmer lid 50 is removed and the exposed removable strainer basket 50 is then temporarily removed from skimmer well 16. Thereafter, cover plate 56 is removed from the bottom of skimmer well 16 and slide valve 52 is rotated to cover pool inlet port 20. In this position, an outside edge portion or web 76 of slide valve 52 is positioned under a sealing stop 74 (see FIGS. 7 and 8) to ensure a complete seal of pool inlet port 20. Thereafter, removable strainer basket 40 is reinserted into skimmer well 16 and relocatable cover plate 56 is placed into sealing contact with the flange 60 of the removable strainer basket 40. Control slide valve 70 is moved to completely exposed liquid flow port 66 whereupon vacuum hose 68 is inserted into the liquid flow port 66. In this configuration, any fluid drawn into the vacuum hose 68 is transmitted into skimmer well 16 where it passes through removable strainer basket 40 thence out of skimmer well 16 via pump outlet port 18.

FIG. 9 shows skimmer 10 configured as an equalizer skimmer. In this embodiment, outlet port 20 communicates with the water in the swimming pool below throat 12 via a pipe 26 shown in chain dotted lines in FIG. 1 (the main drain pipe 24 is not used in this embodiment). A further flap valve 80 is provided at the base of well 16 positioned over pool inlet port 20. The flap valve so positioned rests in sealing contact with the pool inlet port 20 during the normal operation of the skimmer. When flap valve 80 seals pool inlet port 20, all water extracted from the skimmer well 16 via pool outlet port 18 is drawn into the skimmer well 16 through liquid surface throat 12. Accordingly, in normal operation, the equalizer skimmer operates much like the skimmer alone described previously with reference to FIG. 4. However, unlike the skimmer alone described in FIG. 4, the equalizer skimmer of FIG. 9 protects the recirculating pump and associated apparatus of the pool system by ensuring that the skimmer well 16 is always filled with water even if the level of the pool water goes below liquid surface throat 12. When the pool level decreases so that the surface of the pool goes below the liquid surface throat 12, water pressure bearing against the underside of flap valve 80 causes same to open thereby permitting water to enter skimmer well 16 via pool inlet port 20.

Figure 10:
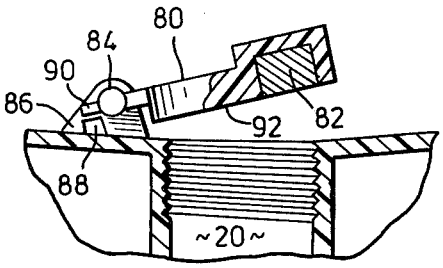
FIG. 10 is a cross-sectional view taken along line 10—10 of FIG. 9.

Referring to FIG. 10, the operation of the flap valve 80 in accordance with the present invention will now be explained. Flap valve 80 is shown positioned slightly above pool inlet port 20 thus permitting flow of water to occur into skimmer well 16 therethrough. Flap valve 80 is urged into closing or sealing contact with pool inlet port 20 by a weight 82 shown at the distal end of the flap valve. The opposite end of the flap valve 80 is provided with an integral hinge pin 84 which may be snapped into an arcuate or C-shaped female recess provided in each of two protrusions 86 shown extending from the bottom of the skimmer well 16. To prevent the flap valve 80 from opening so far as to render itself inoperable, stops 88 are provided in the base of the skimmer well 16 between the protrusions 86. As the flap valve opens, an extension 90 of the flap valve is urged downwardly into contact with stops 88 thereby preventing further opening of the flap valve 80. Weight 82 is chosen so that valve 80 is biased to cover inlet port 20, but differential fluid pressure on either side of the flap valve causes it to open or close. This differential pressure arises to open valve 80 when the water level in well 16 drops below the water level in the swimming pool, which would occur when the pool water lavel drops below throat 12. Thus well 16 is always provided with water as long as the intake of pipe 26 (see FIG. 1) is below the level of the water in the swimming pool.

The flap valve as aforesaid may be constructed of the same material as the skimmer body 10, as for example ABS plastic and the like. These materials will be impervious to the action of chemicals thereon and, accordingly, the flap valve will not deteriorate or be rendered inoperable owing to the corrosive effects of any pool chemicals operating thereon.

The embodiment of FIG. 9 could also be configured to operate as a vacuum as illustrated in FIG. 6. In this case, flap valve 80 would be opened and slide valve 52 would be slid thereunder to cover inlet port 20 as in FIGS. 6 to 8.

FIG. 9 also shows in detail the construction of weir 28 and its associated hinge mounting. The portion of the skimmer body 10 forming the liquid surface throat 12 is formed with two protrusions 94 each protrusion having a concave arcuate or C-shaped female recess 96 which is dimensioned to permit an integral hinge pin 98 formed along the lower edge portion of weir 28 to be snapped thereinto and retained therein. Once the weir 28 is positioned as aforesaid in the protrusions 94, the weir is free to pivot upwardly and downwardly in a self-adjusting fashion corresponding to the pool water level in the liquid surface throat 12. Should removal of the vertically self-adjusting weir subsequently become necessary for replacement or cleaning, it may readily be snapped-out of protrusions 94 simply by pulling upwardly.

Although in the foregoing specification there has been disclosed a preferred embodiment of the invention, it will be appreciated that in light of such disclosure, changes and modifications will suggest themselves to others skilled in the art to which the invention appertains. Accordingly, it will be also understood that the invention is not to be limited to the embodiments thus disclosed by way of example in that the invention includes as well all such modifications, substitutions and changes in the parts and construction of the preferred embodiment as shall come within purview of the claims appended hereto.

What I claim as my invention is:

1. A pool skimmer comprising: a skimmer body having means defining a throat adapted to communicate with the water surface of a pool for entry of pool water into the skimmer; said body having a removable lid for access to the interior thereof; said body also having a well located below the throat, the well having an upper peripheral shoulder defining a well inlet communicating with the throat, the well also having means defining a pump outlet port located in the bottom thereof forming a well outlet; a relocatable cover plate adapted to pass through the well inlet to be located at the bottom of said well to cover the pump outlet port, the cover plate having a peripheral edge portion, an interior liquid flow port for flow of liquid therethrough, and a valve mounted on the cover plate to close said interior flow port; a removable strainer basket adapted to be located in the well above said cover plate, said basket having an upper peripheral annular flange adapted to be located on said well peripheral shoulder, said strainer basket and cover plate being removable from the skimmer body by removing said lid, the annular flange having a central opening smaller in cross-sectional area than the cross-sectional area of the cover plate, so that the cover plate can be positioned on the annular flange to cover the well inlet.

2. A pool skimmer as claimed in claim 1 wherein the well further includes means defining a pool inlet port located in the bottom thereof.

3. A pool skimmer as claimed in claim 2 and further comprising a removable plug for blocking flow through the pool inlet port.

4. A pool skimmer as claimed in claim 2 and further comprising a horizontal slider valve and means for pivotally mounting the slider valve in the bottom of the well, the slider valve being adapted alternatively to slide over and cover one of the pump outlet port and the pool inlet port.

5. A pool skimmer as claimed in claim 1 wherein the slide valve includes a valve member and means for horizontally pivotally mounting the valve member, so that the valve member may be slid horizontally to cover and uncover said interior flow port.

6. A pool skimmer as claimed in claim 5 and further comprising a horizontal slider valve and means for pivotally mounting the slider valve in the bottom of the well, the slider valve being adapted to slide over and cover the pump outlet port.

7. A pool skimmer as claimed in claim 1 and further comprising a horizontal slider valve and means for pivotally mounting the slider valve in the bottom of the well, the slider valve being adapted to slide over and cover the pump outlet port.

8. A pool skimmer as claimed in claim 1 wherein the cover plate interior liquid flow port is adapted to accommodate a vacuum hose, and further comprising means for retaining the vacuum hose in communication with said liquid flow port.

9. A pool skimmer comprising: a skimmer body having means defining a throat adapted to communicate with the water surface of a pool for entry of pool water into the skimmer; said body having a removable lid for access to the interior thereof; said body also having a well located below the throat, the well having an upper peripheral shoulder defining a well inlet communicating with the throat, the well also having means defining a pump outlet port located in the bottom thereof forming a well outlet and means defining a pool inlet port located in the bottom of the well; valve means for selectively closing the pool inlet port; a relocatable cover plate adapted to be located in said well to cover the pump outlet port, the cover plate having a peripheral edge portion and an interior liquid flow port for flow of liquid therethrough; a valve mounted on the cover plate to close said interior flow port; a removable strainer basket adapted to be located in the well above said cover plate, said basket having an upper peripheral annular flange adapted to be located on said well peripheral shoulder, said strainer basket and cover plate being removable from the skimmer body by removing said lid, the annular flange having a central opening smaller in cross-sectional area of the cover plate, so that the cover plate can be positioned on the annular flange to cover the well inlet.

10. A pool skimmer comprising: a skimmer body having means defining a throat adapted to communicate with the water surface of a pool for entry of pool water into the skimmer; said body having a removable lid for access to the interior thereof; said body also having a well located below the throat, the well having an upper peripheral shoulder defining a well inlet communicating with the throat, the well also having means defining a pump outlet port located in the bottom thereof forming a well outlet, the well also having means defining a pool inlet port located in the bottom thereof; a relocatable cover plate adapted to be located in said well to cover the pump outlet port, the cover plate having a peripheral edge portion and an interior liquid flow port for flow of liquid therethrough; a removable strainer basket adapted to be located in the well above said cover plate, said basket having an upper peripheral annular flange adapted to be located on said well peripheral shoulder, said strainer basket and cover plate being removable from the skimmer body by removing said lid, the annular flange having a central opening smaller in cross-sectional area than the cross-sectional area of the cover plate, so that the cover plate can be positioned on the annular flange to cover the well inlet; valve means for selectively closing the pool inlet port, said valve means including a weighted flap valve member and hinge means for hingeadly mounting the flap valve member on the bottom of the well, the hinge means including at least one protrusion formed in the well bottom, the protrusion defining a C-shaped female recess, the hinge means also including a hinge pin formed on the flap valve member and adapted to be snapped into said recess for retention and pivotal movement of the flap valve to cover and uncover the pool inlet port, the flap valve member being weighted to be biased to cover the inlet port and such that differential water pressure on either side of the flap valve causes the valve means to open or close.

11. A pool skimmer as claimed in claim 10 and further comprising an upright weir and means located along the lower edge portion of the weir for hingeably mounting the weir in the skimmer throat, the hinge means including at least one protrusion formed in the throat well, the protrusion defining a C-shaped female recess, the hinge means also including a hinge pin formed along the lower edge portion of the weir, the hinge pin being adapted to be snapped into said recess for retention and pivotal movement of the weir; and the weir including flotation for vertical movement of the weir corresponding to the level of water in the throat.

12. A pool skimmer comprising: a skimmer body having means defining a throat adapted to communicate with the water surface of a pool for entry of pool water into the skimmer; said body having a removable lid for access to the interior thereof; said body also having a well located below the throat, the well having an upper peripheral shoulder defining a well inlet communicating with the throat, the well also having means defining a pump outlet port located in the bottom thereof forming a well outlet, a relocatable cover plate adapted to be located in said well to cover the pump outlet port, the cover plate having a peripheral edge portion and an interior liquid flow port for flow of liquid therethrough; a removable strainer basket adapted to be located in the well above said cover plate, said basket having an upper peripheral annular flange adapted to be located on said well perpherial shoulder, said strainer basket and cover plate being removable from the skimmer body by removing paid lid, the annular flange having a central opening smaller in cross-sectional area than the cross-sectional area of the cover plate, so that the cover plate can be positioned on the annular flange to cover the well inlet; an upright weir and means located along the lower edge portion of the weir for hingeably mounting the weir in the skimmer throat, the hinge means including at least one protrusion formed in the throat well, the protrusion defining a C-shaped female recess, the hinge means also including a hinge pin formed along the lower edge portion of the weir, the hinge pin being adapted to be snapped into said recess for retention and pivotal movement of the weir; and the weir including flotation material for vertical movement of the weir corresponding to the level of water in the throat.

* * * * *